US007686739B2

(12) United States Patent
Vanamo

(10) Patent No.: US 7,686,739 B2
(45) Date of Patent: Mar. 30, 2010

(54) CLIMBING ARRANGEMENT WITH CLIMBING SURFACE

(76) Inventor: Kaarle Vanamo, Kalastajanunaki 10 C 49, Espoo, Southern Finland (FI) FI-02230

( * ) Notice: Subject to any disclaimer, the term of this patent is extended or adjusted under 35 U.S.C. 154(b) by 493 days.

(21) Appl. No.: 11/790,710

(22) Filed: Apr. 27, 2007

(65) Prior Publication Data

US 2007/0254779 A1 Nov. 1, 2007

(30) Foreign Application Priority Data

Apr. 28, 2006 (FI) ..... 20065277

(51) Int. Cl.
*A63B 9/00* (2006.01)
*A63B 22/00* (2006.01)

(52) U.S. Cl. ..... 482/37; 482/51

(58) Field of Classification Search ..... 482/35–37, 482/51, 54; 472/22; 198/861.5
See application file for complete search history.

(56) References Cited

U.S. PATENT DOCUMENTS

| | | | | |
|---|---|---|---|---|
| 5,125,877 | A * | 6/1992 | Brewer | 482/7 |
| 5,328,422 | A * | 7/1994 | Nichols | 482/52 |
| 5,352,166 | A * | 10/1994 | Chang | 482/52 |
| 5,549,195 | A * | 8/1996 | Aulagner et al. | 198/850 |
| 6,095,952 | A | 8/2000 | Ali et al. | 482/54 |
| 6,231,482 | B1 * | 5/2001 | Thompson | 482/37 |
| 6,860,836 | B1 * | 3/2005 | Wu | 482/37 |
| 6,872,167 | B1 | 3/2005 | Meissner | 482/37 |
| 7,195,582 | B2 * | 3/2007 | Wu | 482/37 |
| 7,357,757 | B2 * | 4/2008 | Brown | 482/37 |
| 7,572,208 | B2 * | 8/2009 | Brewer | 482/37 |
| 2002/0169052 | A1 * | 11/2002 | Godsey | 482/37 |
| 2004/0229732 | A1 * | 11/2004 | Wang et al. | 482/37 |
| 2006/0105885 | A1 * | 5/2006 | Jao | 482/37 |
| 2008/0176719 | A1 * | 7/2008 | To | 482/54 |

FOREIGN PATENT DOCUMENTS

| | | |
|---|---|---|
| DE | 10235148 | 2/1920 |
| FR | 2713098 | 11/1993 |
| WO | PCT/US97/18819 | 10/1997 |

* cited by examiner

*Primary Examiner*—Loan H Thanh
*Assistant Examiner*—Allana Lewin
(74) *Attorney, Agent, or Firm*—Fitzpatrick, Cella, Harper & Scinto

(57) ABSTRACT

The invention relates to a climbing arrangement that comprises a rotatable endless belt suspended on a frame structure and forming a climbing surface. The frame structure comprises a first side section that settles beside a first edge of the belt, and a second side section that settles beside a second edge of the belt. A support frame is arranged to support the frame structure. To make the space requirement of the climbing arrangement small and to make it mountable in different environments, the support frame is arranged to support the frame structure asymmetrically by means of a vertical support removably fastened to the support frame on only one side of the frame structure in such a manner that the vertical support is beside one side section only; the frame structure is arranged to fasten to the vertical support optionally on the side of the first side section or the second side section; and the support frame comprises first fastening means and second fastening means for fastening the vertical support to the support frame optionally at a first or a second point to settle the vertical support optionally beside the first side section or the second side section.

17 Claims, 5 Drawing Sheets

CLIMBING ARRANGEMENT WITH CLIMBING SURFACE

BACKGROUND OF THE INVENTION

Figure 1:
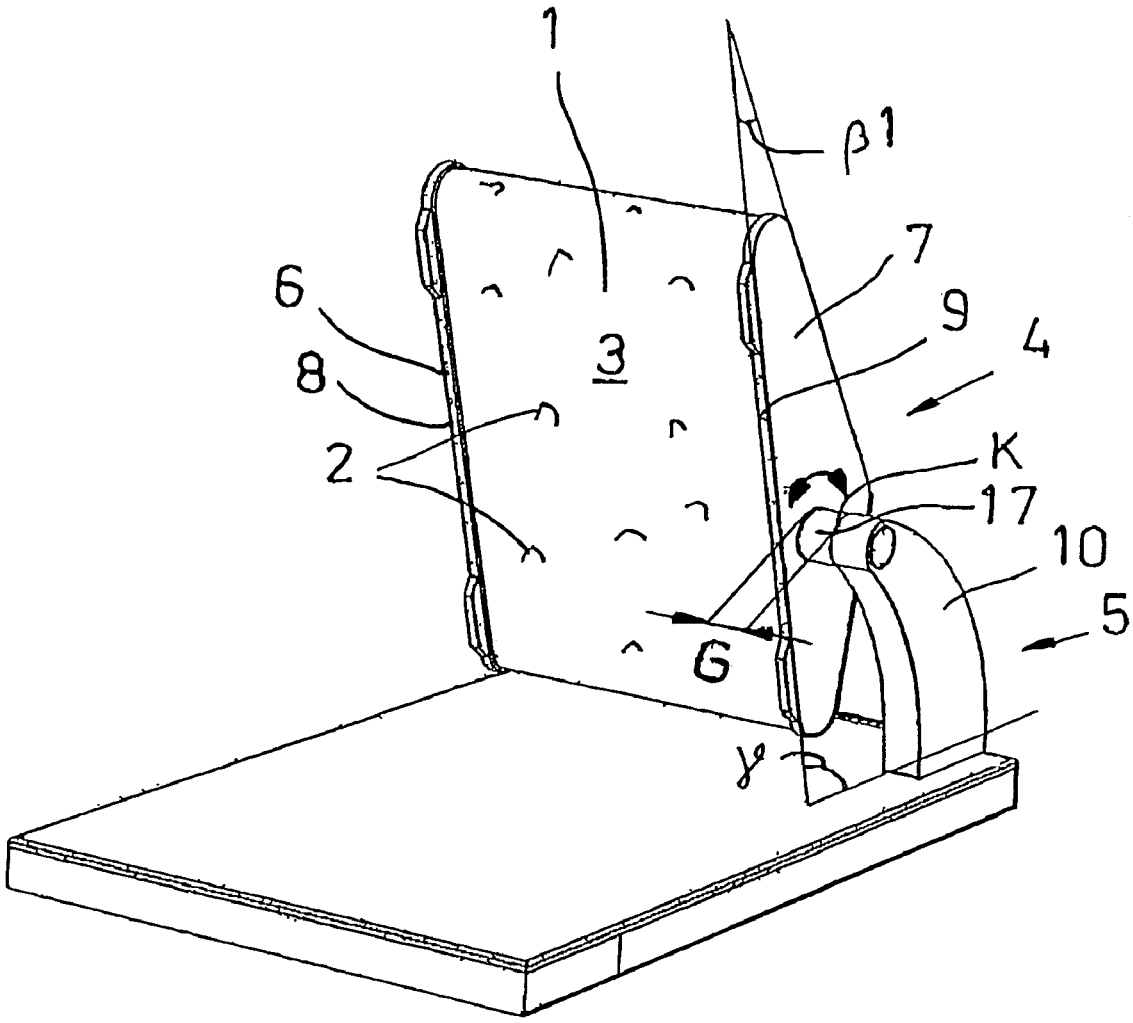

The invention relates to a climbing arrangement comprising a climbing surface and a rotatable endless belt suspended on a frame structure and having on its surface several grip holds for forming a climbing surface. The frame structure comprises side sections on opposite edges of the belt with a first side section beside a first edge of the belt and a second side section beside the opposite edge of the belt, and a support frame for supporting the frame structure.

Climbing arrangements of this type are known from WO publication 98/32496, for instance. They are suitable for use in sports parks and sports centers, for instance.

A problem with the known climbing arrangements is that they require a lot of space, which is why their installation in most different sites of use may be problematic. Their large size also makes them heavy and difficult to transport, which means that they are difficult to move.

BRIEF DESCRIPTION OF THE INVENTION

An object of the invention is to provide a climbing arrangement that eliminates said drawbacks of the known devices and requires only a little space and is physically placeable in most different sites of use.

The climbing arrangement of the invention comprises a rotatable endless belt suspended on a frame structure and having a surface comprising several grip holds for forming a climbing surface, and the frame structure comprises side sections on opposite edges of the belt with a first side section beside a first edge of the belt and a second side section beside the opposite edge of the belt, a support frame for supporting the frame structure, which support frame is arranged to support the frame structure asymmetrically from only one side of the frame structure by means of a vertical support that is removably fastened to the support frame, in such a manner that the vertical support settles beside only one of the two side sections; and in the climbing arrangement, the frame structure is arranged to fasten to the vertical support optionally on the side of the first side section or second side section; and the support frame comprises first fastening means and second fastening means for fastening the vertical support to the support frame optionally at a first point so that the vertical support settles beside the first side section when the climbing arrangement is assembled, or at a second point so that the vertical support settles beside the second side section when the climbing arrangement is assembled.

The support frame of the climbing arrangement preferably comprises a rectangular planar support for supporting the climbing arrangement on a base, whereby the first and second fastening means for fastening the vertical support are also preferably arranged on the edge area of the planar support. At said point, the vertical support can be mounted so that it does not interfere with the use of the climbing support. If the planar support comprises a first edge and an edge opposite the first edge, and the first fastening means are arranged on the first edge and the second fastening means are arranged on the second edge, the same planar support can be utilized to provide a "left-handed" or a "right-handed" climbing support. Thus, there is no need to manufacture and store different components depending on the handedness of the climbing arrangement. Therefore, the side sections of the climbing arrangement are preferably also connected to the vertical support with a common axle that is arranged to extend through holes in the side sections.

The edge of the planar support and a straight line drawn from the first fastening means to a point where the side section fastens to the vertical support preferably form an acute angle of 50 to 80 degrees, whereby the first and second fastening means are preferably also arranged close to the corners of the planar support. Owing to this arrangement, the support frame of the climbing arrangement interferes as little as possible with the use of the climbing arrangement, and a padded mat can also be placed centrally with respect to the frame structure of the climbing arrangement, which in turn reduces the space requirement of the climbing arrangement.

The frame structure supporting the belt is preferably triangular, which means that the tightness of the belt can be easily adjusted, the belt can be made long with respect to the size of the climbing arrangement, and inside the belt, there is a lot of space for various actuators, such as belt rotating devices and frame structure turning devices, which in turn makes it possible to make the climbing arrangement small and compact.

Preferred embodiments of the invention are disclosed in the attached dependent claims 2 to 17.

The greatest advantages of the climbing arrangement of the invention are that its space requirement is small and it is easy to install in different environments. Thus, it is suitable for use for example in sports centers, gyms, sports parks, amusement parks, arcades, venues, ski centers, spas, and even hotels. Due to its small size, it can also be made relatively light and easy to transport. The size of the climbing arrangement is typically 2.2×3×3.5 m (width×length×height), for instance. Due to the asymmetric support of the frame structure, the width of the climbing arrangement is small. If the endless belt of the climbing arrangement is arranged to rotate on three turning points, the belt can be made long with respect to the height of the climbing arrangement, which in turn makes it possible to provide a large number of grip holds on the climbing surface and versatility to the climbing arrangement.

BRIEF DESCRIPTION OF THE INVENTION

Figure 2:
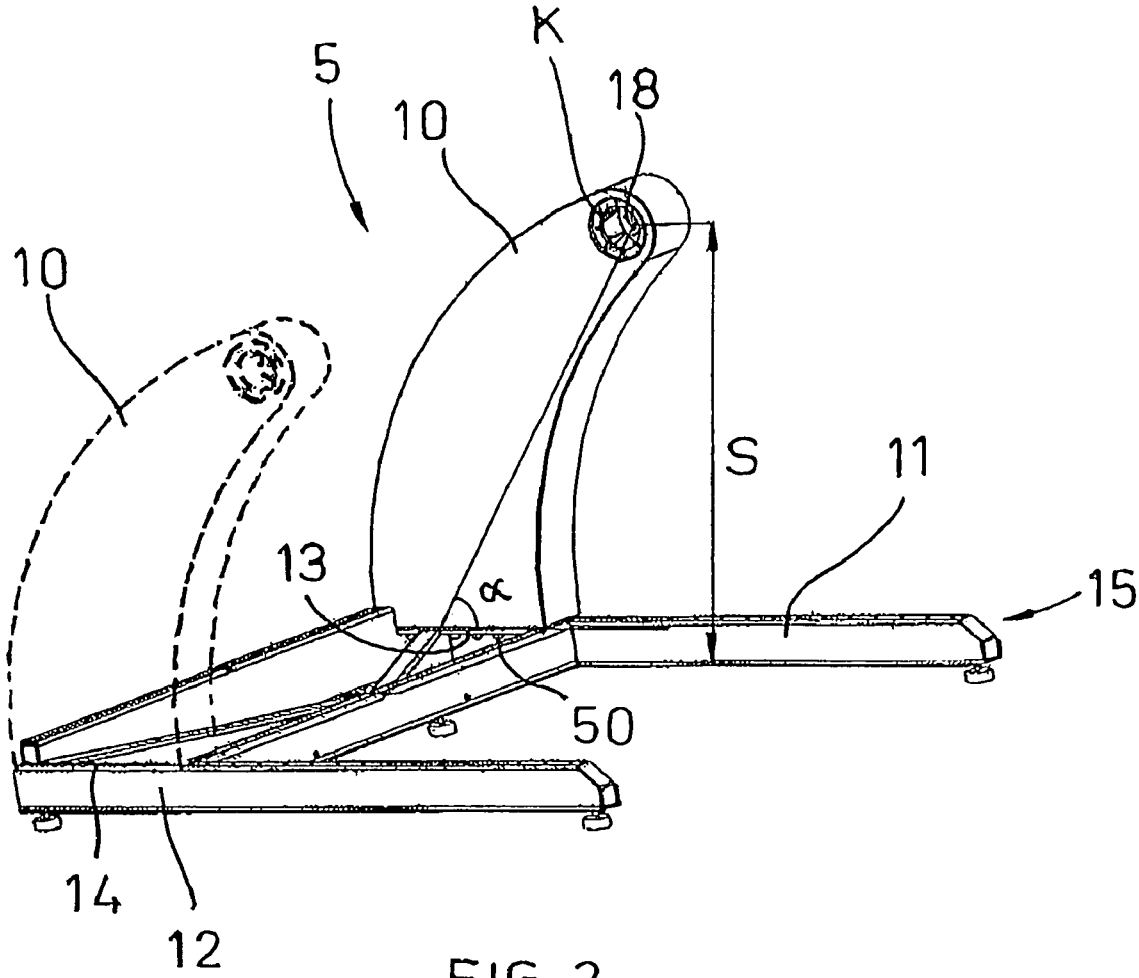
Figure 3:
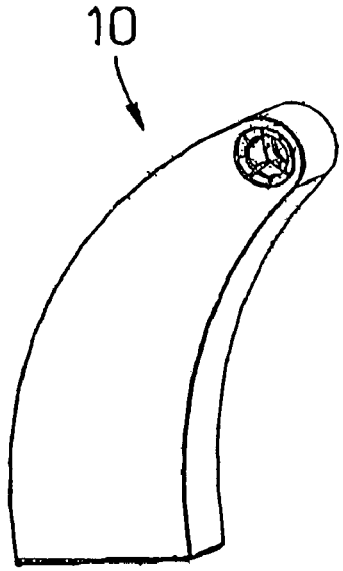
Figure 4:
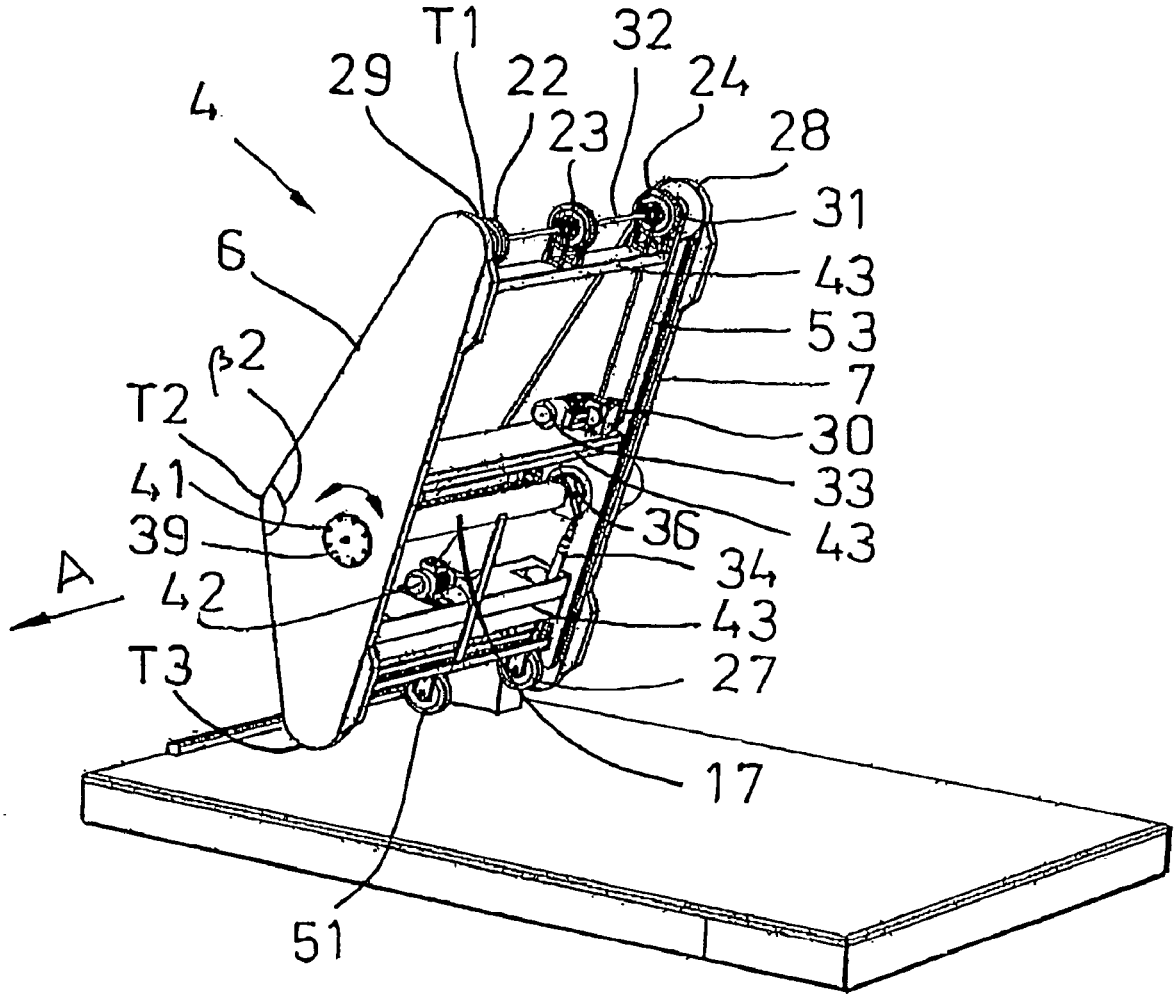
Figure 5:
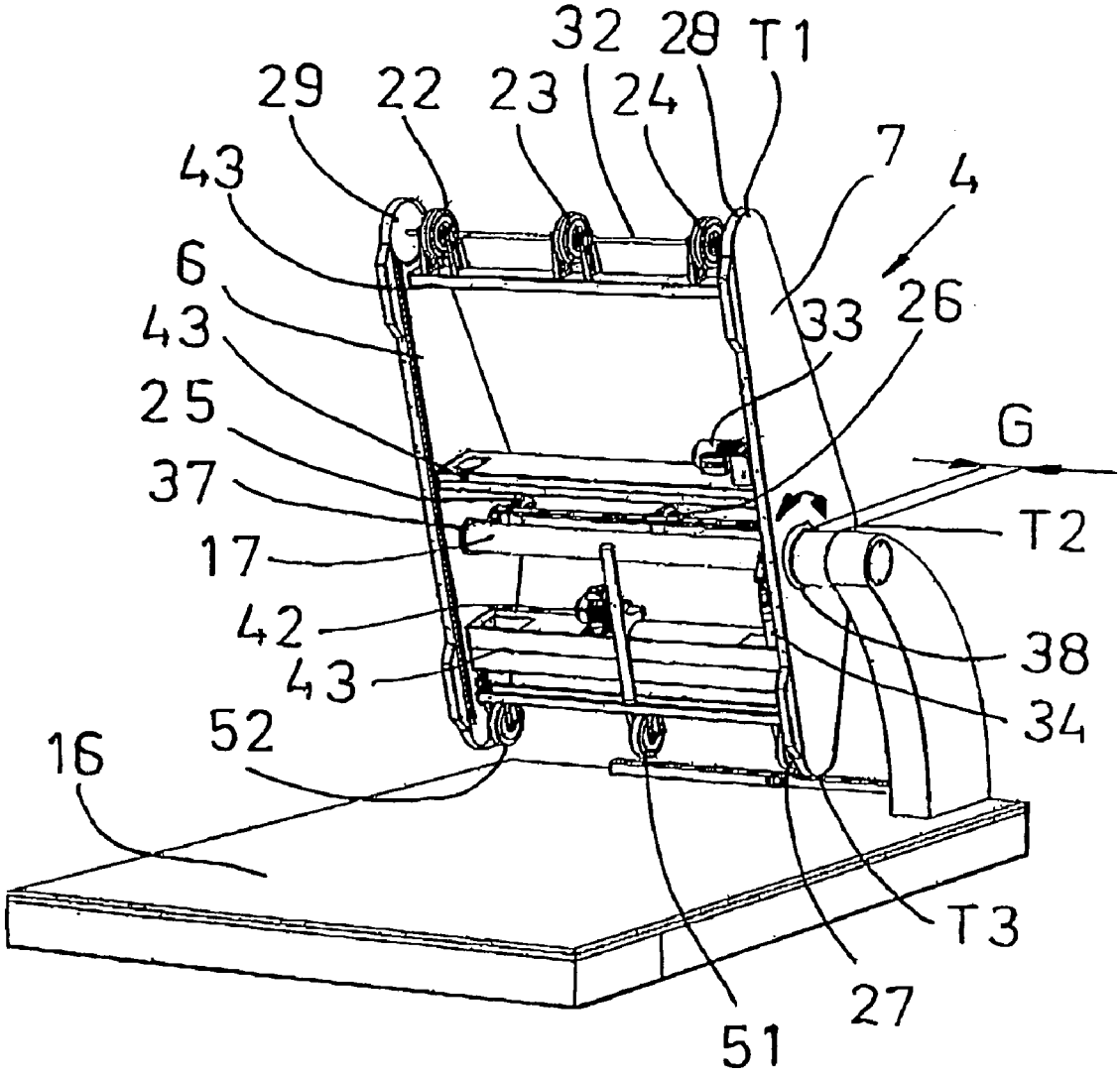
Figure 6:
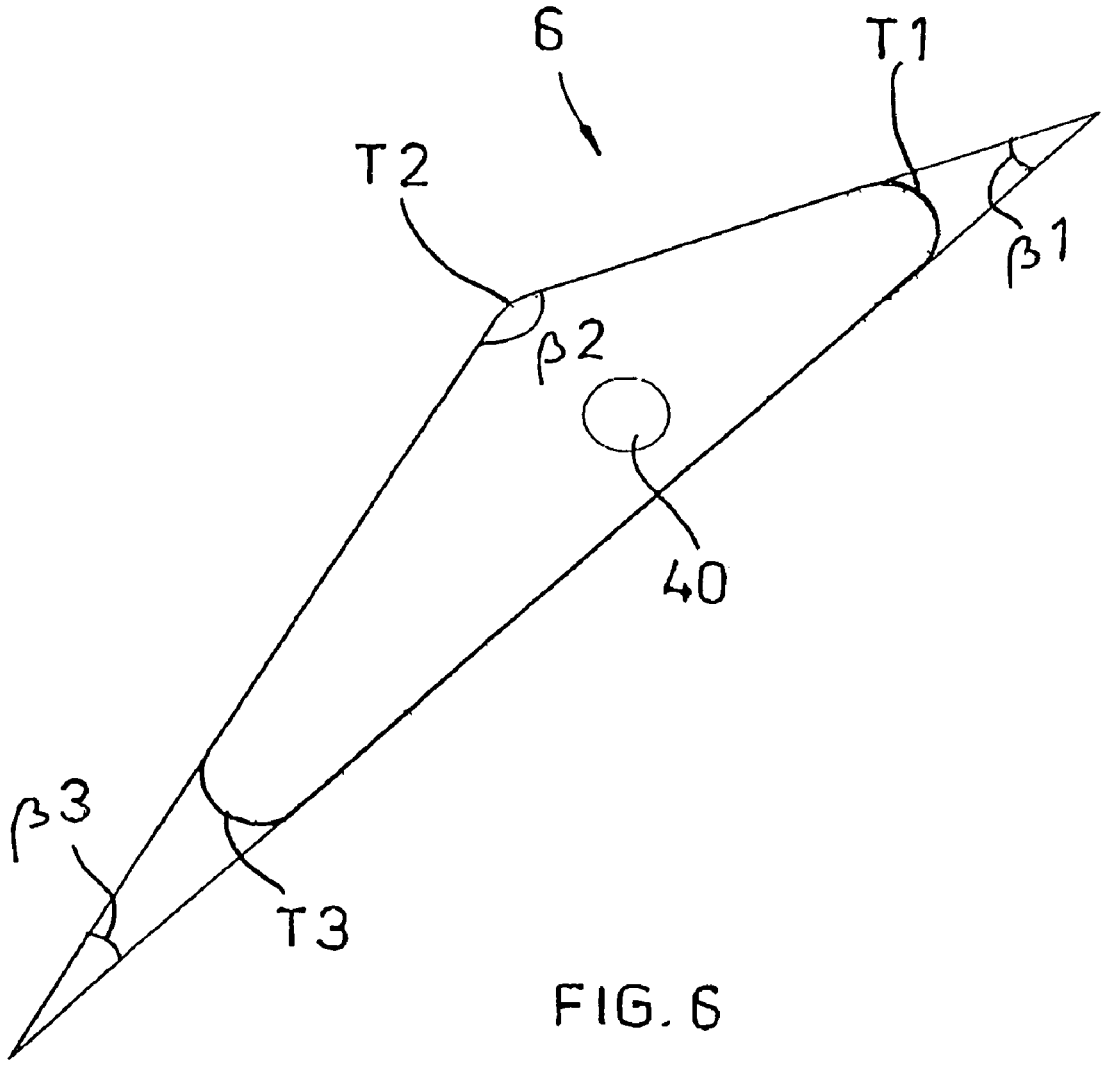

In the following, the invention will be described by means of one preferred embodiment and with reference to the attached drawing, in which FIG. 1 is a general perspective view of a climbing arrangement of the invention, FIG. 2 shows the support frame of the climbing arrangement of FIG. 1, FIG. 3 shows an essential component of the support frame of FIG. 2, FIG. 4 illustrates the structure of the climbing arrangement of FIG. 1, FIG. 5 illustrates the structure of the climbing arrangement of FIG. 1 from an angle differing from that of FIG. 4, and FIG. 6 shows a detail of the support structure of the climbing arrangement.

DETAILED DESCRIPTION OF THE INVENTION

The climbing arrangement of the invention is shown as a general view in FIG. 1. The climbing arrangement comprises an endless belt 1 on a frame structure with several grip holds 2 to form a climbing surface 3. The grip holds 2 provide climbing grips for a user of the climbing arrangement. The frame structure is generally designated by reference number 4, and the frame structure is supported by a support frame that is generally designated by reference number 5.

The belt 1 can be rotated so that a person using the climbing arrangement feels to be climbing even though s/he is essentially stationary with respect to the frame structure 4. The belt 1 can be rotated in both directions, which means that it is possible to climb "downwards", if desired.

The frame structure 4 can be inclined to set the climbing surface 3 at different angles. The double arrow drawn in FIGS. 1 and 4 illustrates the inclination option. In FIG. 1, the inclination angle γ is approximately 100 degrees, whereby the inclination angle is defined as an angle, to which the climbing surface 3 settles relative to the horizontal plane. If desired, the climbing surface can be turned horizontal in such a manner that the grip holds 2 point downwards, in which case the inclination angle is 180 degrees. The climbing arrangement shown in the figure can be inclined at an angle range of γ=10 to 210 degrees.

The frame structure 4 comprises two side sections 6, 7 that settle on corresponding edges 8, 9 of the belt 1. More specifically, the circumferential area of the side sections 6, 7 has edges, inside which the edges 8, 9 of the belt can extend so that there is no gap between the belt edges and side sections. The solution is safe for the user of the climbing arrangement and also prevents rain water from entering inside the frame structure that contains various structures (to be described later in the text) for rotating the belt, inclining the frame structure, etc. Reference number 43 indicates elongated, preferably housing-like members for rigidly connecting the side sections to each other.

The support frame 5 comprises a vertical support 10 that at point K is arranged to support the frame structure 4 at a distance S=approximately 1.5 m from the base, see FIG. 2. The distance S may vary; preferably, it is in the range of 1.2 to 1.7 m. If the distance S is too short, setting the climbing surface 3 into desired positions is not possible. If the distance S were very long (e.g. over 2 m), the climbing arrangement would become unnecessarily large (high) and its support would need to be very strong, which would increase the weight of the climbing arrangement. The risk of injury would also increase, if the user fell down from the climbing surface 3. Point K is in the mid-area of the side section 7 of the frame structure 4, substantially in the middle.

The support frame 5 is arranged to support the frame structure 4 asymmetrically from one side by means of the support 10. Thus, the support 10 is only beside one side section 7 of the climbing arrangement. Owing to this arrangement, the width of the climbing arrangement can be made small, because a safety distance between the vertical support and frame structure need not be arranged on both sides of the support structure 4—because there is only one vertical support. Because the support 10 points upwards, it is referred to as a vertical support 10 in the following. The safety distance G between the vertical support 10 and frame structure 4 is at least 18 cm, for instance 20 cm. The safety distance G is necessary to prevent the fingers of a user of the climbing arrangement from getting jammed between the vertical support 10 and frame structure 4 when the climbing arrangement is being inclined.

FIG. 2 illustrates that the vertical support 10 can alternatively be fastened to both opposite edge supports 11, 12 of the planar and rectangular support 15 belonging to the support frame 5, in other words, either to the first edge 11 or the second edge 12. The vertical support 10 drawn with a dashed line illustrates that it can be moved from one edge support 11 to the other 12 (and vice versa). For this, the edge supports 11 and 12 have fastening means that comprise fastening plates 13, 14. Thus, the vertical support 10 can be fastened with the fastening plates 13, 14 or other corresponding fastening means to the support frame 5 optionally at a first or second point to set the vertical support beside either the first side section 6 or second side section 7.

The vertical support 10 is fastened with screws 50 or other fastening means to the desired fastening plate. The opposite sides of the vertical support 10 are similar in shape and structure. Thus, at point K of the vertical support 10, where a dead axle 17 according to FIGS. 4 and 5 is, there is a through-hole 18.

A line drawn from the fastening plate 13 to point K of the vertical support 10 forms an acute angle α=70 degrees with respect to the edge support 11 of the planar support 15, and the fastening plate 13 is also arranged close to the angle of the planar support. Therefore, the frame structure 4 is supported in such a manner that the vertical support 10 does not interfere with the use of the climbing arrangement, and the planar support 15, to which a padded mat 16 is to be arranged (see FIG. 5), settles below the frame structure 4, and the climbing arrangement does not unnecessarily take up space from the floor surface area. The value of angle α is preferably 50 to 80 degrees. Thus, in the preferred embodiment shown in the figures, the vertical support 10 of the climbing arrangement does not point straight up. If the angle α is too small, the vertical support 10 has to be impractically long for providing the desired height, and then the torque directed to it also becomes big. The padded mat 16 is arranged inside the edge supports 11, 12 of the planar support 15 in such a manner that it can be supported by them, see FIGS. 2 and 5.

The padded mat 16 (not shown in FIG. 2) has sensors (not shown) under it to control the required functions of the climbing arrangement; for instance, the climbing arrangement stops when a strong force is directed to the mat 16.

The frame structure 4 of the climbing arrangement is, as seen from the sides, triangular in shape. The belt 1 is arranged to run over three turning lines T1, T2, and T3, see FIGS. 4 and 5, in which the belt is not shown for the sake of clarity. Turning lines T1, T2, and T3 are at the turning points of the frame structure 4. When the climbing arrangement is used, the climbing surface 3 settles on the plane between turning lines T1 and T3. The length of the plane between turning lines T1 and T3 is approximately 3 m. The length of the plane between turning lines T1 and T2 is approximately 2 m, and the length of the plane between turning lines T2 and T3 is approximately 1.5 m. The total length of the belt 1 is approximately 7 m. Turning lines T1, T2, T3 have rolls 22 to 27, 51, 52. These are preferably made of rubber wheels. The belt 1 is arranged to run on rolls 22 to 27, 51, 52.

Because the frame structure 3 is triangular, the radius of the rolls 22 to 27, 51, 52 in the turning lines can be small, for instance 15 cm, and there still remains a large space inside the triangular frame for the various components. Reference numbers 28 and 29 indicate centralization rolls that are arranged to run at the same speed as the belt. When the belt 1 moves, its edges 8 and 9 settle between the centralization rolls 28, 29 and the belt 1 does not come on top of them. Due to the centralization rolls 28, 29, the belt 1 does not move much sideways, which prevents the edges 8, 9 of the belt from chafing against fixed structures, which might cause the belt to wear quickly.

Turning angle β1 of the belt 1 at turning line T1 is approximately 15 degrees (see FIGS. 1 and 6), turning angle β2 at turning line T2 is approximately 145 degrees (see FIG. 4), and turning angle β3 at turning line T3 is approximately 20 degrees (see FIG. 6). Generally it can be said that the smallest turning angle β of the triangle defined by turning lines T1, T2, and T3 is approximately 10 degrees. If angle β is less than 10 degrees, the space inside the belt 1 for components remains small and no actual "additional length" can be obtained for the belt 1.

An electric motor 33 or some other actuator for running the belt 1 is arranged inside the triangular space defined by the belt 1. The electric motor 33 is arranged to run a belt 53 with belt pulleys 30, 31. Instead of the belt 53 and belt pulleys 30, 31, it is possible to use a chain and gears. Belt pulley 30 is arranged on a rotating axle 32. The earlier mentioned rolls 22 to 24 are arranged on the rotating axle 32. On turning line T2, there are three (or two) rolls. Of these rolls, rolls 25 and 26 are shown in the drawing. One of the rolls can be an adjusting wheel 25 that adjusts the tightness of the belt 1. The position of the adjusting wheel 25 can be mechanically moved to tighten (or loosen) the belt 1.

Reference number 34 indicates an actuator for inclining the frame structure 4. The actuator comprises an electric motor arranged inside a housing-like member 43, the motor being arranged to move by means of a gearbox and preferably a stiff longitudinally adjustable elongated member, such as a telescopic rod, a power transmission means on the axle 17 in such a manner that the frame structure 4 inclines relative to the axle 17.

The frame structure 4 is mounted by bearings 36, 37 on the axle 17. At the bearing points, there are flanged fastening sleeves 38, 39 that settle between the axle 17 and the walls of the holes 40 in the side sections 6, 7 (see FIGS. 4, 5, and 6) in such a manner that the bearings 36, 37 settle between the axle 17 and sleeves 38, 39. The diameter of the holes 40 in the side sections 6, 7 is bigger than the diameter of the axle 17, which means that the frame structure 4 can be removed from the axle 17 in the direction of arrow A after screws 41 or corresponding fastening means in the flange of sleeve 39 are detached from the side section 6.

Reference number 42 indicates a vibration motor that can be used to produce vibration to the belt 1, if desired.

Above, the invention is described by way of example only and it should be noted that the details of the invention may be implemented in many ways within the scope of the attached claims. Therefore, the structure and location of the actuators belonging to the climbing arrangement may vary as may the design of the support frame and the design of the frame structure.

The invention claimed is:

1. A climbing arrangement comprising a rotatable endless belt suspended on a frame structure and having a surface comprising several grip holds for forming a climbing surface, and the frame structure comprising side sections on opposite edges of the belt with a first side section beside a first edge of the belt and a second side section beside the opposite edge of the belt, a support frame for supporting the frame structure, which support frame is arranged to support the frame structure asymmetrically from only one side of the frame structure by means of a vertical support that is removably fastened to the support frame, in such a manner that the vertical support settles beside only one of the two side sections of the frame structure; and in the climbing arrangement the frame structure being arranged to fasten to the vertical support optionally on the side of the first side section or second side section; and the support frame comprising first fastening means and second fastening means for fastening the vertical support to the support frame optionally at a first point so that the vertical support settles beside the first side section when the climbing arrangement is assembled, or at a second point so that the vertical support settles beside the second side section when the climbing arrangement is assembled.

2. The climbing arrangement as claimed in claim 1, wherein the support frame comprises a planar support for supporting the climbing arrangement on a base.

3. The climbing arrangement as claimed in claim 2, wherein the planar support is rectangular and the first fastening means and second fastening means for fastening the vertical support are arranged on the edge area of the planar support.

4. The climbing arrangement as claimed in claim 3, wherein the planar support comprises a first edge support and a second edge support opposite the first edge support, whereby the first fastening means are arranged on the first edge support and the second fastening means are arranged on the second edge support.

5. The climbing arrangement as claimed in claim 3, wherein the first edge support of the planar support and a straight line drawn from the first fastening means to a point, where the side section fastens to the vertical support, form an acute angle of 50 to 80 degrees.

6. The climbing arrangement as claimed in claim 5, wherein the point where the side section fastens to the vertical support is at a distance of 1.2 to 1.7 m from the planar support.

7. The climbing arrangement as claimed in any one of claims 3 to 6, wherein the first fastening means and the second fastening means are arranged close to the corners of the planar support.

8. The climbing arrangement as claimed in claim 2, wherein the planar support comprises walls for receiving a padded mat.

9. The climbing arrangement as claimed in claim 1, wherein the endless belt is arranged to run on three turning lines (T1, T2, T3) in such a manner that the belt forms a first planar surface, a second planar surface, and a third planar surface, of which the first planar surface is the larger than the second planar surface and the third planar surface.

10. The climbing arrangement as claimed in claim 9, wherein the turning lines define a triangle whose smallest angle (β) is at least approximately 10 degrees.

11. The climbing arrangement as claimed in claim 10, wherein the actuator for running the endless belt is arranged inside a volume defined by the endless belt.

12. The climbing arrangement as claimed in claim 10, wherein belt tightness adjustment means are arranged in the corner of the turning line (T2) where the largest angle (β2) of the triangle is positioned.

13. The climbing arrangement as claimed in claim 1, wherein the side sections connect to the vertical support by means of a common axle that is arranged to extend through holes in the side sections.

14. The climbing arrangement as claimed in claim 13, wherein the side sections are mounted with bearings to the axle at the holes, whereby the frame structure is turnable by means of the bearings relative to the axle for setting the climbing surface at different angles.

15. The climbing arrangement as claimed in claim 13 or 14, wherein the diameter of the holes is bigger than the diameter of the axle, and flanged fastening sleeves are arranged between the holes and axle.

16. The climbing arrangement as claimed in claim 13, wherein the axle has a power transmission means for turning the frame structure by means of an actuator arranged in the volume within the belt.

17. The climbing arrangement as claimed in claim 1, wherein there is a safety distance of at least 15 cm between the vertical support and the side section beside it.

* * * * *